US008648759B2

(12) United States Patent
Wang et al.

(10) Patent No.: US 8,648,759 B2
(45) Date of Patent: Feb. 11, 2014

(54) VARIABLE HEIGHT RADIATING APERTURE

(75) Inventors: Allen Wang, Fullerton, CA (US); Fangchou Yang, Los Angeles, CA (US); Jason G. Milne, Hawthorne, CA (US)

(73) Assignee: Raytheon Company, Waltham, MA (US)

( * ) Notice: Subject to any disclaimer, the term of this patent is extended or adjusted under 35 U.S.C. 154(b) by 188 days.

(21) Appl. No.: 13/249,587

(22) Filed: Sep. 30, 2011

(65) Prior Publication Data

US 2013/0082890 A1 Apr. 4, 2013

(51) Int. Cl.
*H01Q 13/10* (2006.01)

(52) U.S. Cl.
USPC ..... 343/770; 343/700 MS; 343/767; 343/795; 343/797; 343/803; 343/816; 343/817; 343/820; 343/821; 343/853

(58) Field of Classification Search
USPC ..... 343/770
See application file for complete search history.

(56) References Cited

U.S. PATENT DOCUMENTS

| | | | | |
|---|---|---|---|---|
| 5,227,808 | A * | 7/1993 | Davis | 343/915 |
| 6,067,053 | A * | 5/2000 | Runyon et al. | 343/797 |
| 6,621,465 | B2 * | 9/2003 | Teillet et al. | 343/797 |
| 7,444,736 | B1 | 11/2008 | Warning | |
| 2003/0214452 | A1 * | 11/2003 | Ippolito | 343/797 |
| 2010/0052975 | A1 | 3/2010 | Milano et al. | |

FOREIGN PATENT DOCUMENTS

| | | |
|---|---|---|
| EP | 0434282 A2 | 12/1990 |
| WO | WO9827611 | 6/1998 |

OTHER PUBLICATIONS

Yamaguchi, S. et al: "Ultra-Wideband Tapered Slot Antenna Array with Parallel Plate Waveguides", Antenna Technology Small Antennas and Novel Metamaterials, 2006, IEEE Inernation Workshop on Crown Plaza Hotel, White Plains, New York, Mar. 6-8, 2006, Piscataway, NJ, USA, IEEE, Mar. 6, 2006, pp. 57-60, XP010910728, DOI: 10.1109/IWAT.2006. 1608974; ISBN: 978-0-7803-9443-8.

* cited by examiner

*Primary Examiner* — Jerome Jackson, Jr.
*Assistant Examiner* — Hai Tran
(74) *Attorney, Agent, or Firm* — Pierce Atwood LLP; Joseph M. Maraia

(57) ABSTRACT

Provided herein are devices, systems and techniques for establishing a variable height conformal antenna array having a planar backplane. More particularly, positioning of radiating elements can be made insensitive to variable ground height by selecting a suitable radiating element, such as a flared notch and arranging them to have a profile such that their outer extremities are positioned along a conformal, curved shape. Differences in radiator heights can be taken up by the addition of parallel vertical ground planes disposed between the radiating elements and the backplane. Adjacent vertical ground planes effectively form cutoff waveguide sections that naturally isolate the backplane from the radiating elements. The vertical ground planes edges effectively form a virtual curved ground for the radiating elements, following curvature of the array profile. Accordingly, heights of radiating elements are uniform with respect to the virtual ground, while being allowed to vary with respect to the backplane.

15 Claims, 10 Drawing Sheets

VARIABLE HEIGHT RADIATING APERTURE

GOVERNMENT RIGHTS

This invention was made with Government support via Contract No. FA8650-08-D-3857. The Government may have certain rights in this invention.

TECHNICAL FIELD

Various embodiments are described herein relating generally to the field of antennas, and more particularly to conformal antenna arrays.

BACKGROUND

There is a need for lightweight, structural panel arrays in sensor platforms, such as the AWACS, Predator, and other unmanned air vehicles. Many such aerospace applications require that the antenna be built onto the skin of the sensor platform, thereby requiring an exposed surface, or face, of the antenna aperture to be conformal or curved. Such conformal panel arrays require variable height radiating aperture since the backside electronic panels are typically planar. Also, as structural members, such arrays require load-bearing apertures.

It is generally desirable that aperture performance be maintained over a wide bandwidth and a wide scan range (e.g., a 40% bandwidth and a 60-degree conical scan). One of the difficult challenges in constructing such variable height antenna apertures is that anomalies are introduced into the array performance, at least in part, due to surface waves generated and supported by such a curved aperture. As individual radiating element of such a conformal array radiate electromagnetic energy, at least a portion of the energy is typically directed towards the backplane. This situation results in reflections of the electromagnetic waves, with implications to performance parameters, such as the radiation pattern and efficiency (e.g., variations to driving point impedance, which lead to increased return loss). Such effects can be compensated for, at least to some extent, for single radiator embodiments, or arrays with uniform antenna height above the backplane. A serious complication, however, in dealing with conformal arrays is that the various radiating elements are each disposed at different heights adding a multi-dimensional complexity. Consequently, such conformal arrays may operate with restrictions or undesirable constraints to parameters, such as radiation pattern performance (e.g., gain, side lobe suppression, beam widths) and bandwidth (e.g., return loss, VSWR).

One solution uses a faceted approach, in which both the aperture and the array electronics are locally planar, with portions of the array being displaced from a common plane according to the desired array profile. Another approach requires that the entire aperture and array electronics each be curved in a similar manner, so that the radiating elements effectively "see" a constant ground plane height. From an aperture design standpoint, aperture can be treated as a circular or cylindrical array. Either category of approach adds complexity to the overall antenna assembly design, as electronic modules and other components associated with such arrays must be housed according to complicated geometries.

SUMMARY

Described herein are embodiments of systems and techniques for developing a variable height radiating aperture that can be incorporated in a structural conformal array having a substantially planar backplane.

In one aspect, at least one embodiment described herein provides an antenna array including an electrically conducting ground plane and first and second electrically conducting walls, each extending between a respective lower edge and a respective upper boundary. The first wall is in electrical contact with the ground plane along its lower edge and extends away from the ground plane. The antenna array also includes a first group of antennas, each antenna of the first group disposed at a uniform distance relative to the upper boundary of the first wall. The second electrically conducting wall is also in electrical contact with the ground plane along its lower edge and also extends away from the ground plane substantially parallel to the first wall. The second wall includes a second group of antennas, each antenna of the second group disposed at a uniform distance relative to the upper boundary of the second wall. The first and second electrically conducting walls are separated from each other by a separation distance. At least one region of the respective upper boundary of each of the first and second walls is disposed at a different height with respect to other regions of the upper boundaries of the first and second walls, when measured with respect to the ground plane.

In some embodiments, the separation distance is less than about one-half a shortest anticipated wavelength of operation. Generally, each antenna of the first and second pluralities of antennas is positioned for maximum radiation in a direction away from the ground plane. Each antenna of the first and second groups of antennas can be selected from the group consisting of: notch antennas; dipole antennas; patch antennas; travelling wave antennas; directional antennas and combinations thereof.

In at least some embodiments, the antenna array further includes an orthogonal electrically conducting wall extending between a lower edge and an upper boundary, the orthogonal wall being in electrical contact with the ground plane along its lower edge and extending away from the ground plane, the orthogonal wall also intersecting each of the first and second walls at an intersection angle. In some embodiments, a third group of antennas is provided, with each antenna disposed at a uniform distance relative to the upper boundary of the orthogonal wall.

In some embodiments, at least some antennas of the third group of antennas disposed on the orthogonal, wall respectively bisect antennas of at least one of the first and second groups of antennas. Each of the bisected antenna pair of the first and third groups of antennas and the second and third groups of antennas can be adapted for common-phase center, dual-polarized, or elliptically polarized operation.

In some embodiments, the antenna array further includes phase offsets in electrical communication between pluralities of antennas. The phase offsets are adapted to steer a radiation pattern of the antenna array.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A description of embodiments of systems and processes for developing a variable height radiating aperture that can be incorporated in a structural conformal array having a substantially planar backplane follows. More particularly, the radiator design and techniques described herein are insensitive to variable ground height. This can be accomplished by selecting a suitable radiating element (e.g., an endfire radiating element, such as a dipole or a flared notch), in which the outer extremities or "tips" of the radiating element follow a curvature shape. The same radiator profile can be maintained across the aperture. Differences in radiator heights can be taken up by vertical ground planes disposed between the radiating elements and the ground planes, which forms cutoff waveguide sections that naturally provide a virtual curved ground plane for the radiating elements. Differences in radiator path lengths can be corrected electronically by standard techniques, for example in a transceiver module. In addition, the new aperture has lower front-end loss and offers growth to wider band applications (>40% BW) than existing designs that require a separate balun layer.

A variable-height radiator includes an antenna array formed by multiple antenna elements. The radiating elements collectively define an antenna aperture that follows a line or surface that is disposed in a non-parallel arrangement with respect to a planar backside. For example, such an array aperture can follow a curve, such as a radius of curvature making it well suited for panel array applications. In at least some embodiments, such antenna apertures can be made structural and load-bearing. The devices, systems and techniques described herein provide a simplified RF transition, which simplifies grounding requirements for such arrays, such as the tying of vertical radiator strips to a horizontal ground plane. The approaches described herein can be extended to nonlinear polarizations, for example, by providing a dual polarized aperture.

Figure 1:
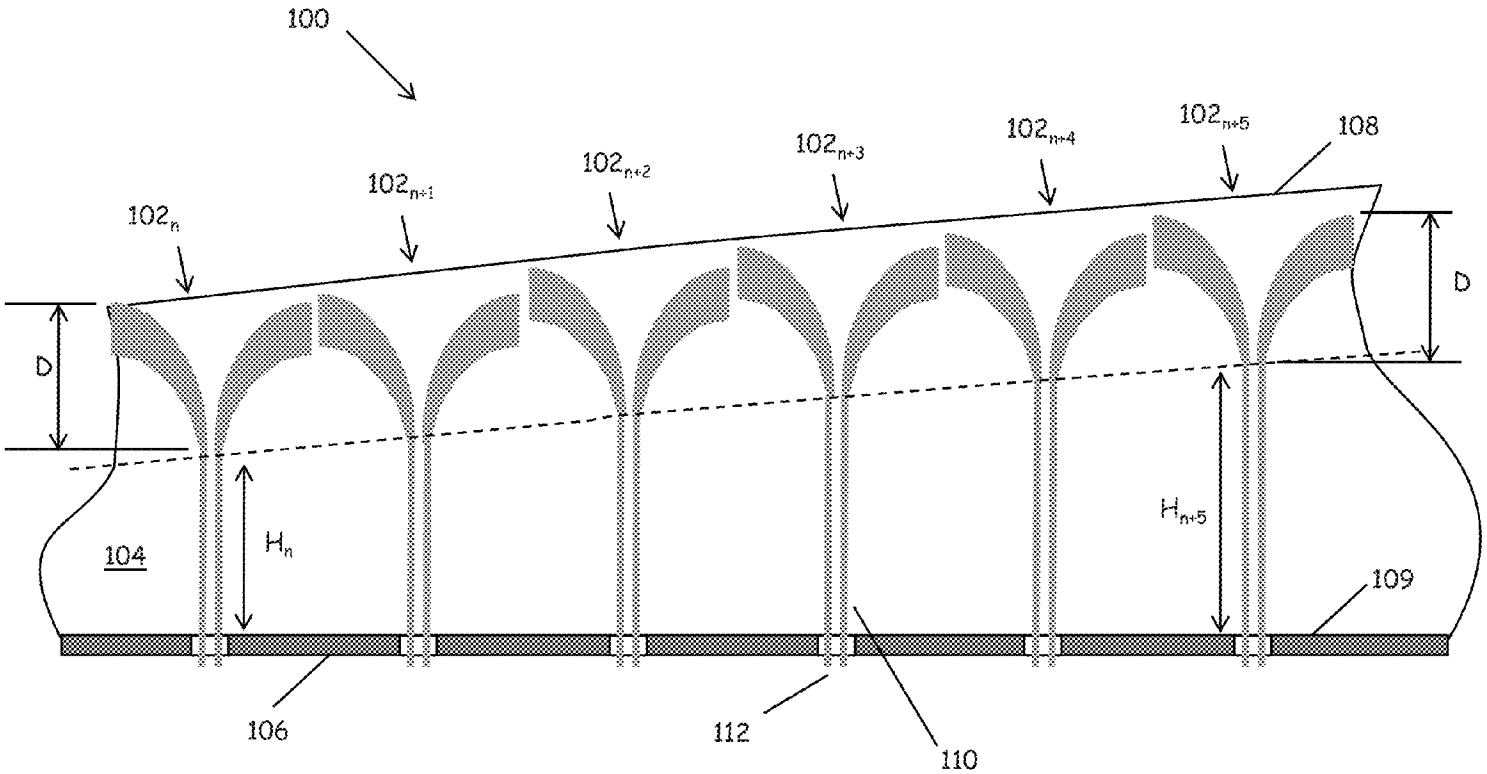
PRIOR ART FIG. 1
FIG. 1 shows a schematic representation of prior art antenna array.

A schematic representation of vertical radiator strip portion of a prior art antenna array is shown in FIG. 1. The illustrated portion of a sub array 100 includes a group of antennal elements $\mathbf{102}_n$, $\mathbf{102}_{n+1}$, $\mathbf{102}_{n+2}$, $\mathbf{102}_{n+3}$, $\mathbf{102}_{n+4}$, $\mathbf{102}_{n+5}$ (generally 102), in this case "bunny-ear" radiating elements, arranged along a common axis, and within a common sub-array plane 104. The radiating elements 102 are substantially identical, being uniform in height D (e.g., 1.5 inches) and arranged with a uniform lattice spacing $S_E$ (e.g., 0.5 inches). A reference ground plane 106 shown in profile is provided along a lower edge 109 of the sub array 100. In this instance, the reference ground plane 106 is referred to as being horizontal and the sub-array plane 104 as being vertical to suggest an orthogonal relationship between the two. In some configurations, the horizontal ground plane 106 serves as a back plane for a two-dimensional array. For example, such a two-dimensional array can include similar sub arrays vertically arranged, parallel to each other and perpendicular to the horizontal backplane. A lattice spacing $S_H$ between such of the multiple sub arrays can be the same as element spacing $S_E$ (e.g., 0.5 inches), thereby providing a uniform, square lattice spacing.

An outer edge 108 of the vertical plane 104 defines an array aperture curve that is non-parallel to horizontal ground plane 106. The aperture curve 108 resides in one or more of an elevation plane or azimuthal plane. Each element 102 of each sub array 100 is positioned at a respective height $H_n$ above the horizontal ground plane 106. In particular, the height of each of the portrayed sub array elements 102 differs from its neighbors according to the aperture curve 108. The outer-most portions of the radiating elements 102 (i.e., tops) effectively define, or otherwise follow the aperture curve 108.

Also shown are example transmission lines or "feed" lines 110 for each radiating element 102, extending upward from the horizontal ground plane 106 toward an input or driving point of the radiating element 102. The lengths of such feed lines 110 also vary according to their respective element heights above the backplane. Electronics (not shown) as may be used with such an array 100 can be positioned along an opposite side of the horizontal ground plane 106, such that the ground plane 106 serves as an electromagnetic shield, protecting the electronics from external radiation, such as radiation from the elements 102 themselves. Accordingly, each of the feed lines 110 is shown as crossing through the horizontal ground plane 106 allowing for interconnection to such electronics. As with any antenna array, the electronics can include one or more of transmitters, receivers, interconnecting transmission lines, phase adjusting elements, fixed phase offset elements, amplifiers, filters, attenuators, couplers, control processors, and the like.

Interactions between the radiating elements 102 and the horizontal ground plane 106 produce reflections that otherwise affect overall performance of the array. With each sub array element having a different respective spacing to the ground plane 106, there are multiple different interactions (e.g., reflections) that can negatively impact overall performance of the array 100. Such multiple reflections could impact sidelobe suppression, or at least complicate processing to control of such sidelobe suppression. Alternatively or in addition, the non-uniform spacing might impact bandwidth performance, for example, by introducing or otherwise complicating the control of reflected energy from the antenna elements (e.g., return loss).

Figure 2:
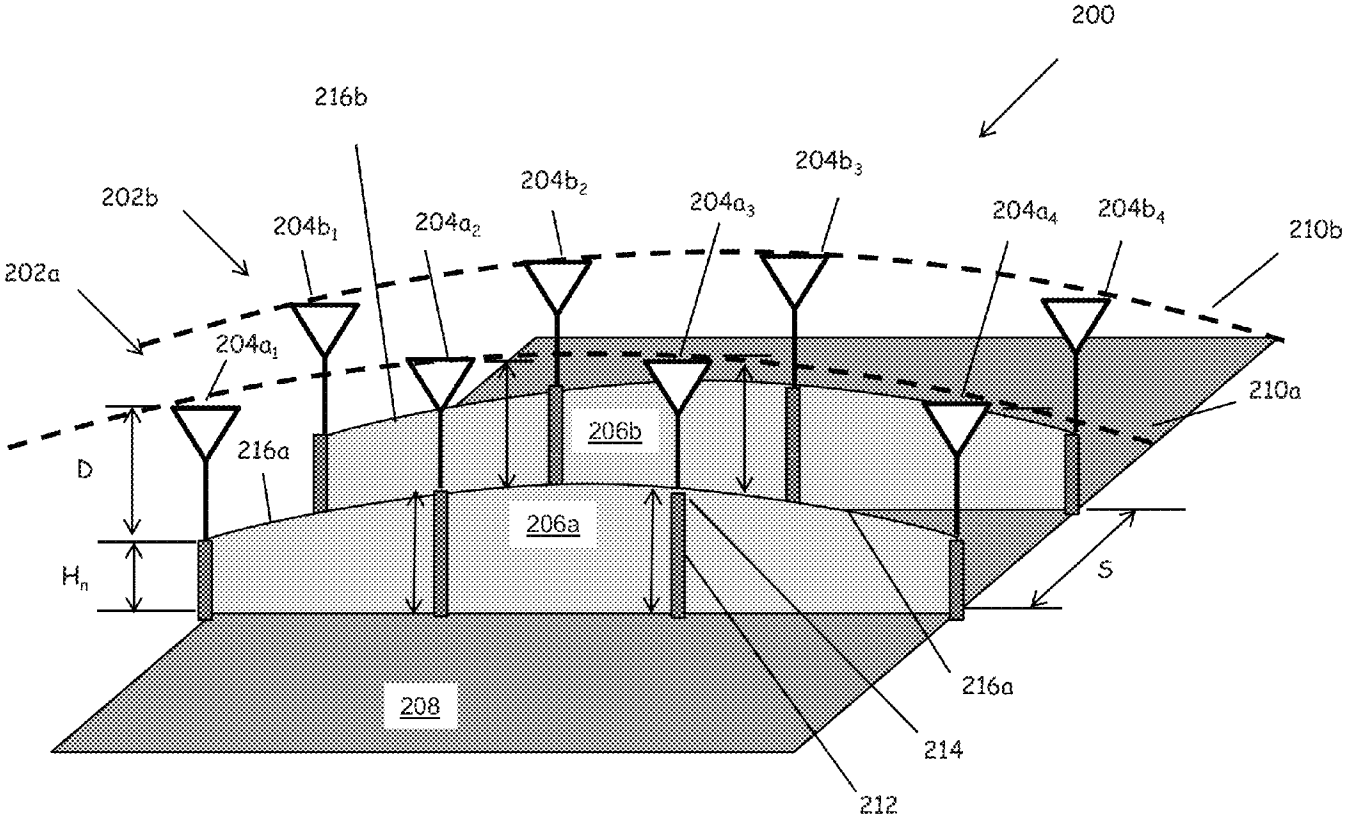
FIG. 2 shows a schematic representation of an embodiment of an antenna array.

Beneficially, the devices, systems and techniques described herein are substantially insensitive to variable ground plane heights. A schematic representation of an embodiment of a height-insensitive antenna array is shown in FIG. 2. The illustrative antenna array 200 includes two sub arrays 202*a*, 202*b* (generally, 202). Each sub array 202 includes four radiating elements $\mathbf{204}a_1$, $\mathbf{204}a_2$, $\mathbf{204}a_3$, $\mathbf{204}a_4$, $\mathbf{204}b_1$, $\mathbf{204}b_2$, $\mathbf{204}b_3$, $\mathbf{204}b_4$ (generally 204) arranged along respective vertical planes 206*a*, 206*b* (generally 206). The two vertical planes 206 are substantially parallel with respect to each other and perpendicular to a common horizontal ground plane, or backplane 208.

In the illustrative embodiment, each of the radiating elements 204 is substantially identical, having uniform dimensions, particularly with respect to height D measured within a plane parallel to the vertical plane 206. Those portions of the individual radiating elements 204 farthest from the backplane 208 (i.e., tops) define an aperture curve 210*a*, 210*b* (generally 210), similar to the aperture curve 108 illustrated in FIG. 1. Each of the antenna elements 204 is fed by a respective feed line 212 having a height $H_n$ measured from the backplane 208 to a feed point 214 of the radiating element 204. As illustrated, the lengths of the transmission lines 212 vary according to the height of the respective antenna element 204 above the backplane 208.

In an important distinction, however, each of the vertical planes 206 includes a respective virtual ground boundary 216*a*, 216*b* (generally 216) within the respective plane 206. The virtual ground boundary 216 is selected to provide a uniform spacing D to the respective aperture curve 210, and similarly to each of the antenna elements 204. In the illustrative example, the virtual ground boundary 216 is positioned to coincide with the driving points 214 of each of the antenna elements 204, although this is in no way meant to be limiting. Conceivably, the virtual ground boundary 216 could reside above or below the respective antenna element driving points 214, as long as the separation between the virtual ground boundary 216 and the aperture curve 210 is constant in at least each of the antenna sub arrays 202.

At least a substantial portion of the region between the virtual ground boundary 216 and the backplane 208 is electrically conducting. In the illustrative example, the entire vertical plane 206 below the virtual boundary 216 and the backplane 208 is formed by an electrically conducting plane, referred to as a vertical ground plane 206. It is conceivable that the vertical ground plane 206 and the backplane 208 are in electrical contact with each other.

In operation, at least a portion of radiated energy from the antenna elements 204 is directed toward the backplane 208. Without the benefits provided by the virtual ground boundary 216, such energy would otherwise reflect from the backplane 208 and interact with radiated energy from the radiating element 204 and perhaps other radiating elements 204 in a manner dependent upon the non-uniform spacing of the aperture curve 210 above the backplane 208. By the nature of the vertical conducting ground planes 206, however, an electromagnetic phenomenon referred to as "waveguide below cutoff" can result in dramatic reduction if not elimination of electromagnetic interaction between the antenna elements 204 and the backplane 208.

Conceptually, the two vertical ground planes 206 can be considered to form a parallel plate waveguide. Electromagnetic energy directed from the antenna elements toward a parallel plate waveguide opening formed by the virtual ground boundaries 206 of each of the vertical ground planes 206 can give rise to propagating waveguide modes within the waveguide, depending upon the wavelength of the radiation and the separation of the walls of the waveguide (i.e., separation S between the vertical ground planes 206). With such waveguides, however, there is a wavelength above which substantially no propagating modes can be supported. Such a wavelength is referred to as a cutoff wavelength $\lambda_c$ and for the parallel plate waveguide configuration illustrated herein, generally corresponds to about one-half of the highest operating frequency (i.e., one half the shortest wavelength $\lambda_{min}/2$). Thus, separation between adjacent vertical planes 206 can be selected to establish a cutoff frequency $f_c$, thereby isolating the radiating elements 204 from the backplane 208.

The exposed edges of parallel plate waveguide structures formed by leading edges 216 of the vertical planes 206 effectively establish a new, virtual ground boundary. Beneficially, upon proper selection of shape and position of the leading edges 216, the virtual ground boundary 216 can be uniformly separated from the aperture curve 210, as illustrated. This results in the introduction of a virtual ground plane to provide the radiating elements an equivalent constant electrical height ground plane. A significant benefit of such spacing is reduction or elimination of unwanted reflections from the non-uniformly spaced backplane 208 in favor of reflections from the uniformly spaced virtual ground plane 216.

The ground "trough" created by adjacent elements acts like a cutoff waveguide. Most of the backward traveling energy will not reach the horizontal ground plane if the ground trough is greater than about $\lambda/8$.

Figure 3:
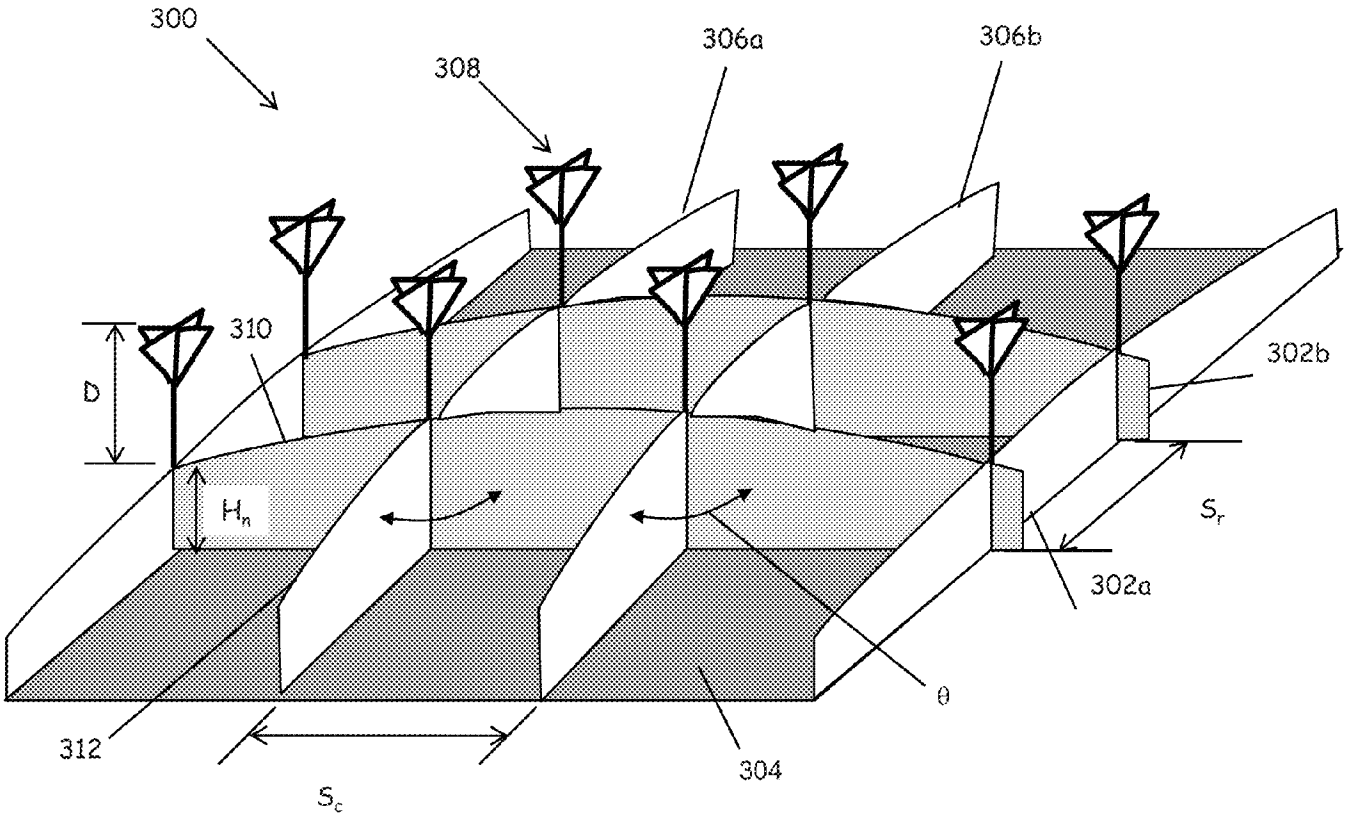
FIG. 3 shows a schematic representation of another embodiment of an antenna array.

A schematic representation of another embodiment of an antenna array is shown in FIG. 3. The array 300 includes at least two vertical ground planes 302*a*, 302*b* (generally 302) extending along a first common direction, each being disposed perpendicularly above a common horizontal ground plane or backplane 304. The array 300 also includes at least two other vertical ground planes 306*a*, 306*b* (generally 306) extending along a second different common direction. An angle of intersection θ is formed by intersection of the two parallel groups of vertical ground planes 302, 306. In at least some embodiments, the angle of intersection is 90 degrees. Such structures forming a regular rectangular grid are sometimes referred to as "egg crate" antenna arrays taken from their egg crate appearance.

Disposed above each of the vertical ground planes 302, 306 are a respective number of antenna elements 308. The antenna elements 308 can be located at the intersection of the vertical planes 302, 306, as shown, or along the respective vertical ground planes 302, 306 between the intersections. When formed at the intersections, the antenna elements 308 can be formed as "crossed" elements, such as crossed dipoles.

As in the example described above in reference to FIG. 2, the antenna elements 308 are disposed at non-uniform heights $H_n$ above the backplane 304, but at regular and uniform heights D with respect to virtual ground boundaries 310, 312 formed along respective vertical ground planes 302, 306. Once again, the "waveguide below cutoff" effect is relied upon to selectively isolate the backplane 304 from the antenna elements 308 at frequencies below cutoff $f_c$. A minimum height, or spacing above the backplane 304 for any of the embodiments described herein, should be chosen such that energy otherwise blocked by the waveguide-below-cutoff effect will be damped sufficiently (backward impedance sufficiently high) to realize a desired benefit. In at least some embodiments, spacing of antenna elements 308 above the ground plane 304 $H_n$ is greater than a minimum height of about one eighth of a wavelength (i.e., $\lambda/8$). Greater minimum heights (e.g., $\lambda/4$, $\lambda/2$) can be selected, for example, when incorporated into non-planar platforms.

In egg-crate-style embodiments, the equivalent waveguide structures can be considered as rectangular waveguides. Column separation $S_c$ between vertical ground planes 306 and row separation $S_r$ between vertical ground planes 302 can be established based upon intended frequencies of operation to ensure that waveguide below cutoff criteria are satisfied over the entire frequency band of operation.

With crossed elements 308, such as crossed notch radiators, it is possible to provide horizontal polarization, vertical polarization, right-hand circular polarization and left-hand circular polarization. Of course, circular polarization would require an appropriate feed design providing a phase offset (e.g., +/−90 degrees) between each portion of the crossed element.

The antenna elements in any of the embodiments described herein can be any suitable radiating elements, including generally narrowband elements, such as monopoles, dipoles, patches, and generally broadband elements, such as flared notches and the like. In at least some embodiments, the antenna elements themselves can be array-type elements, such as Yagi Uda array, log periodic structures, such as log periodic dipoles, log periodic spirals, and the like.

In some embodiments, one or more of the ground planes can be formed from rigid metals, such as sheet metals or castings. Alternatively or in addition, one or more of the ground planes can be formed from layered structures, such as metals layered on a substrate. Some examples include printed circuit board type structures, such as microstrip, stripline, and the like. Other structures include metal coated insulators, such as a rigid polymer (e.g., plastic) coated with a conductive layer. Such polymer substrates can be formed from any suitable known technique, such as blow molding, casting, and the like. Conductive coatings can be applied according to any of a number of known techniques, such as painting, dipping, laminating, and the like. When serving as structural members, selection of substrate material and/or thickness can be taken into consideration in view of anticipated loading requirements.

Figure 4:
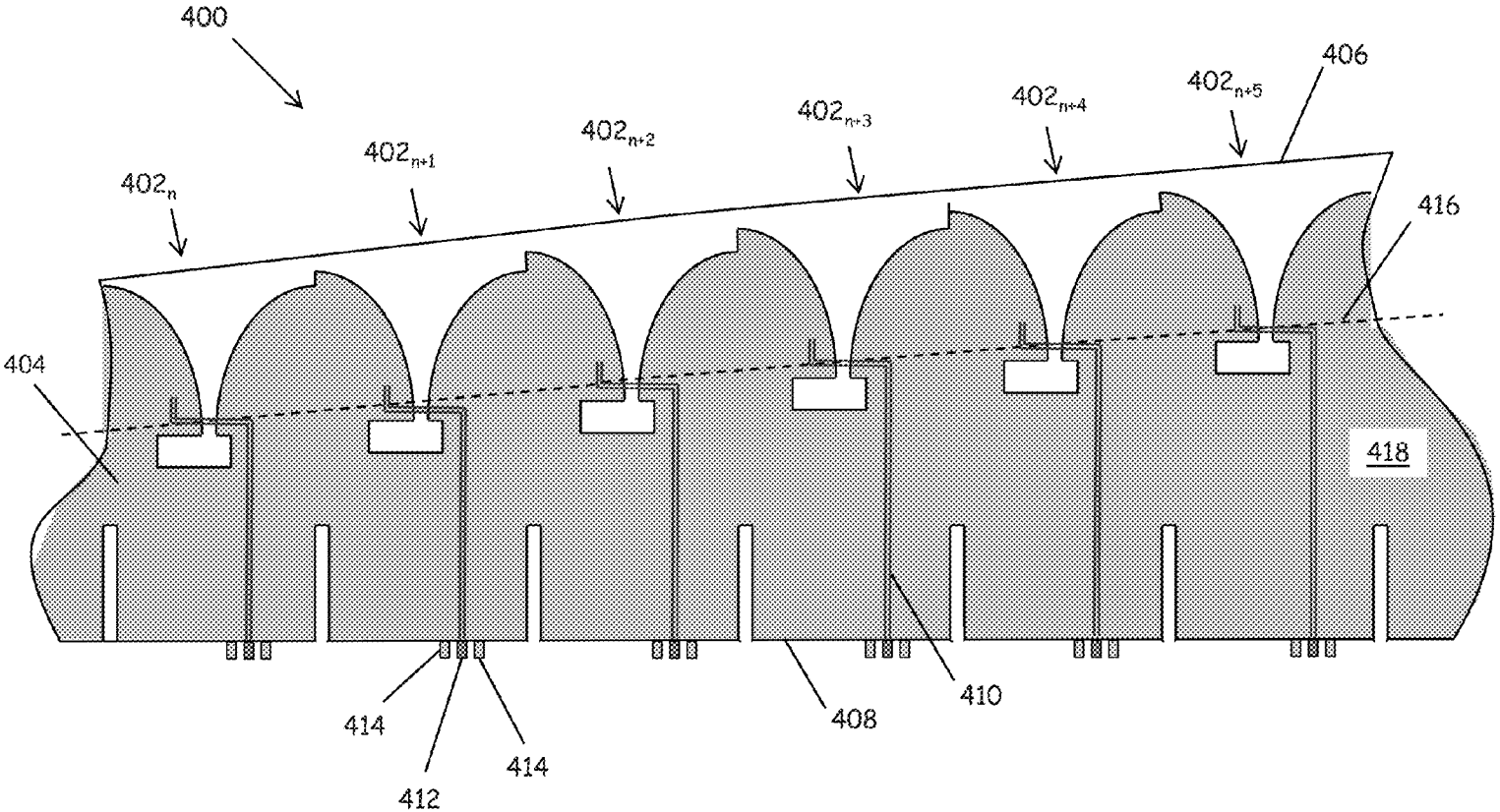
FIG. 4 shows a planar view of an embodiment of a portion of an antenna array.

A planar view of a portion of another embodiment of antenna sub array is shown in FIG. 4. The sub-array 400 includes a group of flared notch antennas $\mathbf{402}_n$, $\mathbf{402}_{n+1}$, $\mathbf{402}_{n+2}$, $\mathbf{402}_{n+3}$, $\mathbf{402}_{n+4}$, $\mathbf{402}_{n+5}$ (generally 402) disposed along a common vertical ground plane 404. The flared notch antennas 402 are arranged for radiation with respect to a common horizontal ground plane (not shown). In the illustrative example, the flared notch antennas 402 are arranged to abut adjacent antennas so as to avoid any open space between antenna elements. Outer extremities of the flared-notch elements are arranged along a common aperture curve 406 that is non-parallel to a lower edge, or base 408 of the vertical ground plane. Each of the flared-notch elements 402 is fed by a respective transmission line 410 extending up from the lower edge 408. As such, the lengths of the transmission lines 410 differ according to respective height of each flared notch antenna elements 402 above the lower edge 408.

In the illustrative embodiment, the feed line 410 is formed using microstrip techniques, such that a conductive strip is run along and above a ground plane. Here, the ground plane of the microstrip feed line 410 is contiguous with the conductive portions forming the flared notch antenna elements 402. A signal contact 412 for the microstrip signal line 410 is shown extending beyond the lower edge 408 of the vertical ground plane, suitable for interconnection to antenna array electronics, for example, through the horizontal ground plane (not shown). Also shown are two ground contact tabs 414 also extending beyond the lower edge 408 of the vertical ground plane. In at least some embodiments, such tabs 414 are suitable for electrical interconnection to the horizontal ground plane. Greater or fewer numbers of ground contacts 414 can be provided. In at least some embodiments, an ground contact 414 can be formed along substantially the entire lower edge of the vertical ground plane 404 and the horizontal ground plane, for example, by soldering, welding, or the like. It is worth noting that one of the advantages of establishing a waveguide below cutoff configuration is that it lessens restrictions in interconnecting the bases of the vertical ground planes to the horizontal ground planes, such that one or two contact tabs per element can suffice.

A dashed curve 416 is drawn through a common portion of each flared-notch antenna elements 402, generally corresponding to the elements driving point. As can be observed, the dashed curve 416 generally follows the aperture curve 406, being displaced from the aperture curve 406 by a distance corresponding to the antenna element height D. The dashed curve 416 corresponds to a virtual ground boundary, considering the microstrip backing portion extending from the antenna element feed point to the lower edge 408 as a ground plane 418. Beneficially, the virtual ground boundary 416 will serve as an approximate boundary for waveguide below cutoff phenomena when two or more like sub arrays 400 are positioned parallel to each other.

Figure 5:
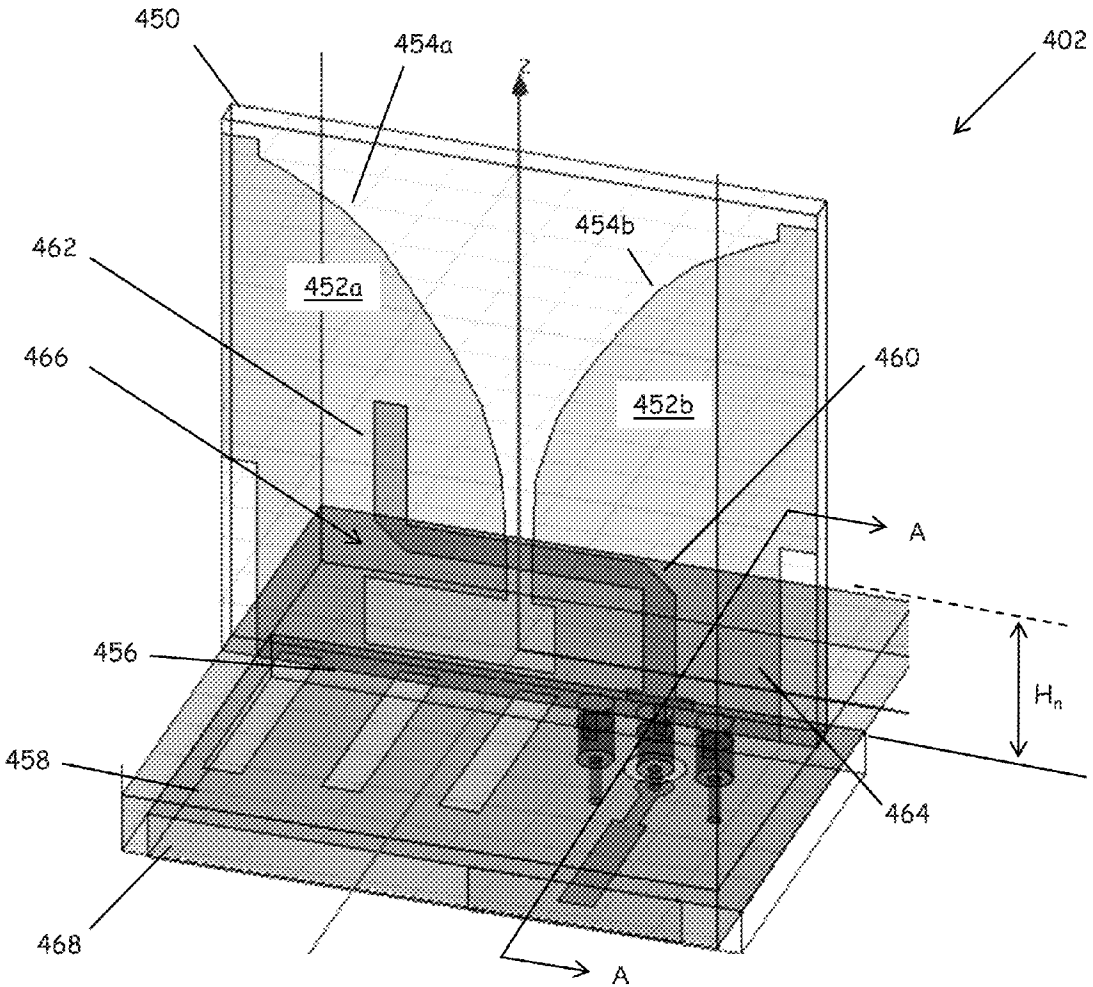
FIG. 5 shows a perspective view of the antenna element shown in FIG. 4.

A perspective view of an embodiment of a flared-notch antenna element 402 usable in any of the antenna arrays described herein is shown in FIG. 5. The flared-notch element 402 includes a vertical planar support 450 having two parallel conductive surfaces 452*a*, 452*b* (generally 452). Each of the conducting surfaces 452 is respectively terminated in opposing curved edge 454*a*, 454*b* arranged along either side of a centerline. In the illustrative embodiment, the vertical planer support 450 includes a lower edge 456 arranged to abut a horizontal ground plane 458, or backplane.

The flared-notch element 402 is fed by a microstrip line 460 extending upward from the lower edge 456 and crossing a narrowed, driving point of the flared-notch element 402 at a right angle. The microstrip line 460 forms another 90 degree turn upwards forming a stub tuning element 462 configured to form an optimal impedance match to the flared-notch element 402 according to well-known antenna design techniques. The two parallel conducting surfaces 452 are contiguous with a vertical ground plane surface 464 extending from a driving point of the antenna element 402 downward to the lower edge 456. A rectangular aperture 466 formed at the base of the flared-notch element 402 is also provided as part of the antenna element feed and matching network.

The horizontal ground plane 458 includes a conducting surface formed on a supporting substrate 468. The microstrip line 460 can extend through an aperture in the ground plane 458 to an opposite side of the ground plane 458 to facilitate interconnection to other electronic circuitry as may be provided for use with antenna arrays.

Figure 6:
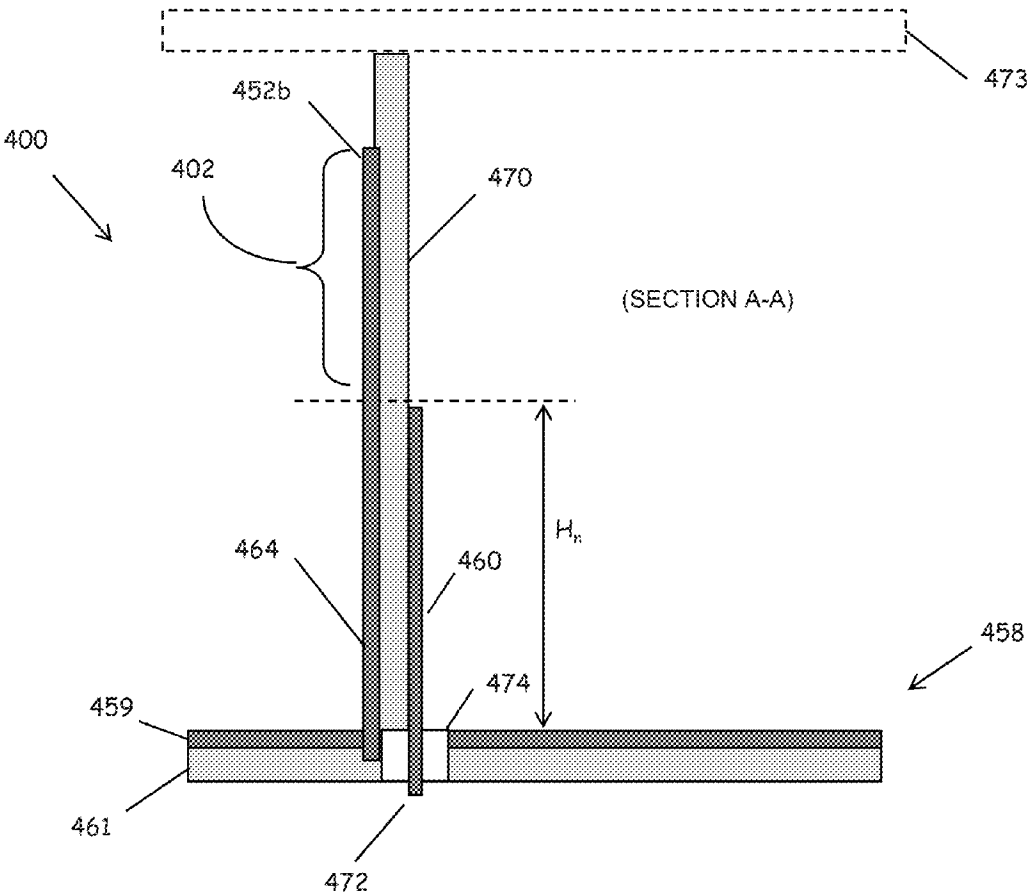
FIG. 6 shows a cross-sectional view of an embodiment of a portion of an antenna array.

Referring to FIG. 6, a cross section view (Section A-A) of an embodiment of a portion of an antenna array is shown in more detail. In particular, the antenna element 402 is formed by conducting surface layer 452*b* along one side of the supporting vertical substrate 470. The vertical ground plane 464 is also shown along the same side of the vertical substrate 470, with the ground plane 464 and antenna element conducting surface layer 452*b* being contiguous. The microstrip feed line 460 is also shown extending along an opposite side of the vertical substrate 470. A feed point contact 472 extends through an aperture 474 of the horizontal ground plane 458. The horizontal ground plane 458 can include a conducting layer 459 disposed upon a supporting substrate 461. In at least some embodiments, one or more of the substrates 461, 470 can include cyanate ester quartz (CEQ). For example, CEQ at thicknesses of about 50 mils can be used for the base 461, and at a thickness of about 25 mils for the vertical 470, for an array having radiator heights of about 0.5 inches.

In at least some embodiments, one or more of the supporting substrates 461, 470 can be structural elements. It is further contemplated that a radome 473 (shown in phantom) could be combined with any of the antennas or antenna array structures described herein. As illustrated, the radome 473 can be disposed above the ground plane 458, effectively sandwiching the sub arrays 400 between the radome 473 and the ground plane 458. In at least some embodiments, the radome 473 can follow aperture curve 406 or contour of the various sub arrays 400. It is also conceivable that such a radome can be formed upon the sub arrays 400 using standard radome construction techniques and relying on the sub arrays 400 to provide structural support for the radome. Examples of such radomes include thicknesses of 17.6 mils and 35.2 mils, for example, fabricated from cyanate ester quartz (CEQ).

Figure 7:
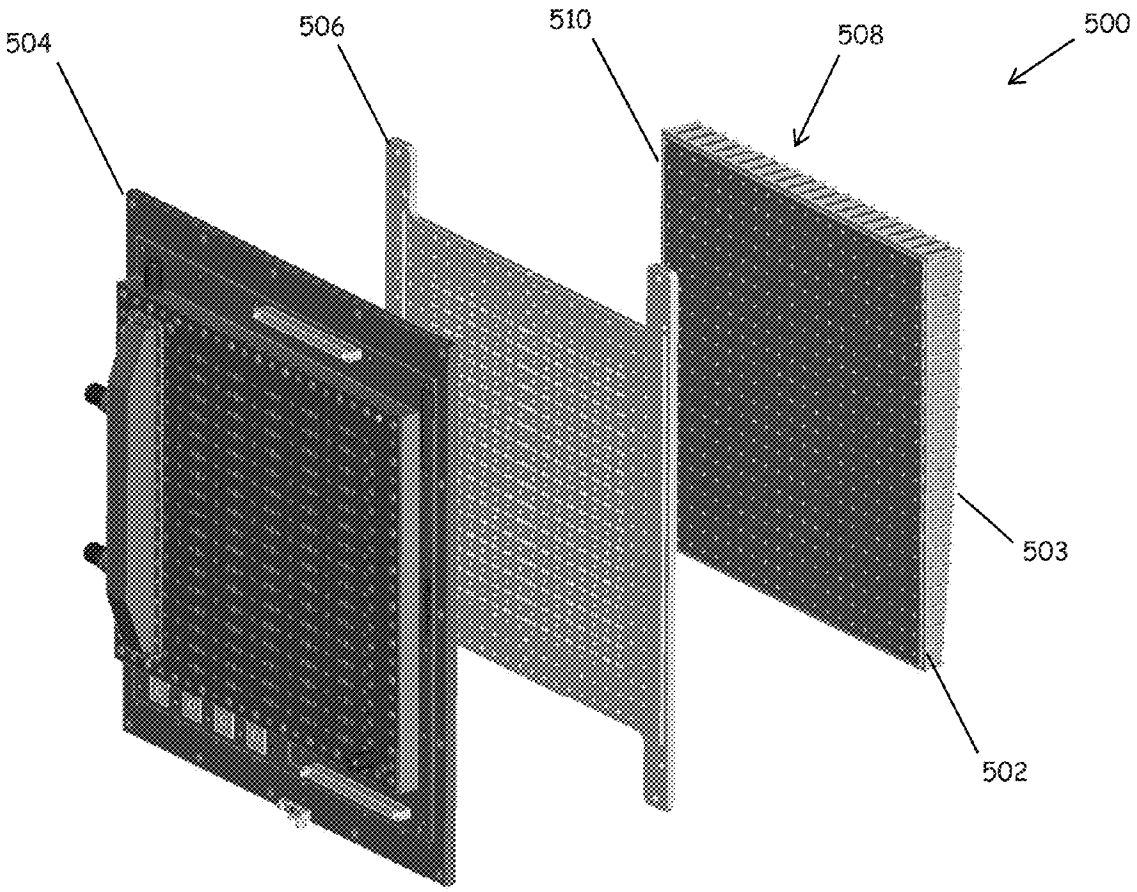
FIG. 7 shows an exploded perspective view of an embodiment of an antenna assembly including a conformal antenna array.

The antenna arrays described thus far are generally part of a larger antenna array assembly. An exploded perspective view of an embodiment of such an antenna assembly including a conformal antenna array 500 is shown in FIG. 7. The assembly 500 includes an antenna module 502, and electronics module 504, and an interface module 506. In the illustrative example, the antenna module 502 includes an egg crate array of radiating elements 508 arranged according to the techniques described herein. Namely, the antenna module 502 includes antenna elements 508 forming a conformal or otherwise curved array surface 503 disposed above a common planar backplane. A horizontal ground plane is formed along the backplane, under each antenna element of the array. In the illustrative embodiment, the antenna assembly 502 also includes an RF interface board 510 disposed along the backplane. In particular, the RF interface board 510 is located on an opposite of the horizontal ground plane and thereby at least partially shielded from radiation of the antenna elements 508.

The electronics module 504 includes electronic assemblies and/or components as may be necessary for operation of the antenna array assembly 500. For example, the electronics module 504 typically includes an RF distribution network configured to selectively interconnect one or more of the antenna elements to one or more of a transmitter and a receiver. The RF distribution network may include one or more of transmission lines, RF couplers, switches, amplifiers, filters, attenuators, fixed phase offsets, such as delay lines, variable phase offsets, power supplies and control elements. In at least some embodiments, the control elements, in combination with other components of the electronics module, are adjusted to configure the antenna array assembly as a steerable phased array according to generally well known techniques. In at least some embodiments, one or more of the electronics module, the interface module and the antenna module are configured to provide thermal management. Such thermal management can be accomplished, for example, by one or more of heat sinks and active coolers. Such active cooling can include one or more of forced cooling air, circulating cooling fluid, and thermoelectric coolers.

Figure 8:
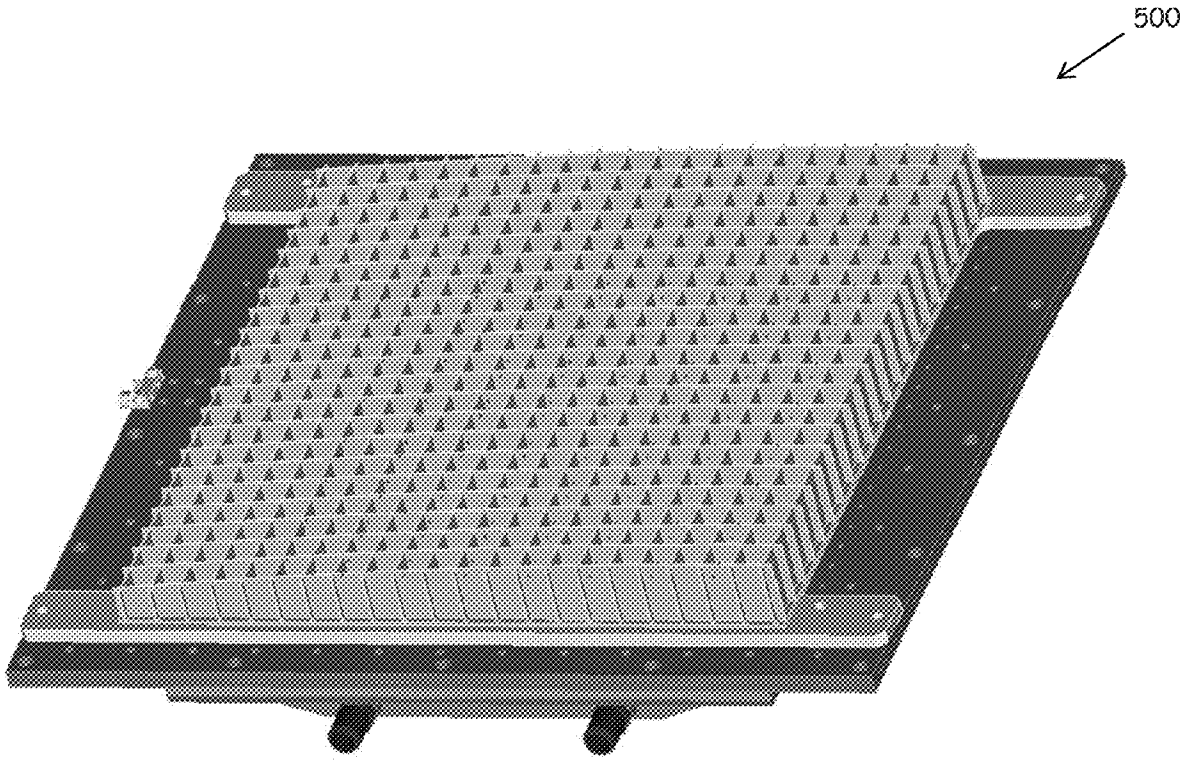
FIG. 8 shows a perspective view of the antenna assembly shown in FIG. 7.

In at least some embodiments, the antenna assembly 500 includes an interface module 506. For example, the interface module 506 can include, for example, a spring pin adapter plate to facilitate interconnection between the RF interface board 510 of the antenna assembly 502 with the electronics module 504. A perspective view of the antenna assembly 500 shown in FIG. 8.

Figure 9:
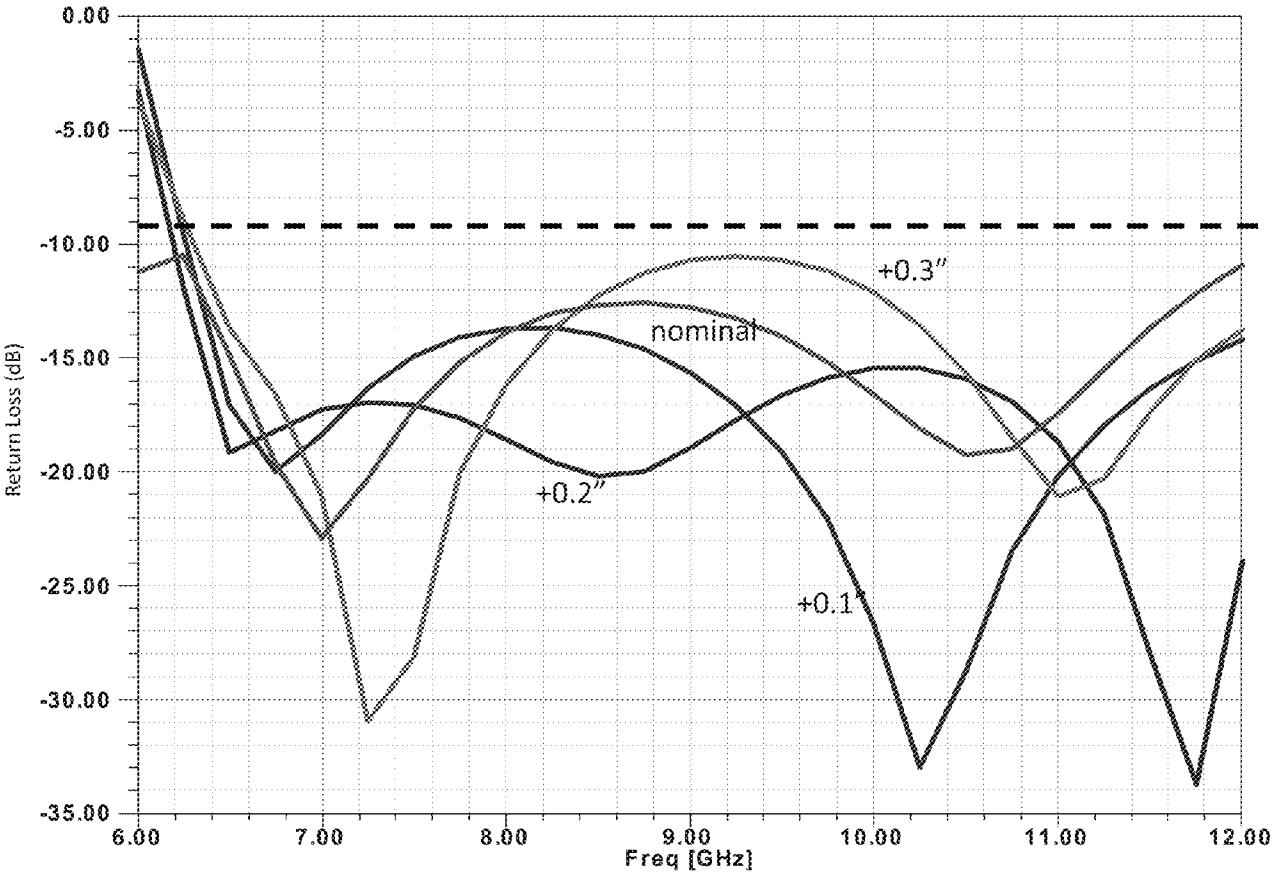
FIG. 9 shows a graphical representation of return loss versus frequency of an embodiment of an antenna array element constructed according to the techniques described herein for various element heights.

Referring to FIG. 9, a return loss curve illustrates the return loss for of an embodiment of an antenna array element constructed according to the techniques described herein for various element heights relative to an underlying horizontal ground plane. In particular, the array includes flared notch elements with variable height radiators, including 256 elements at 0.5" lattice separation and an 8" square active area. The return loss curve represents that portion of power directed into the antenna element feed circuit that is reflected back from the antenna element. A return loss of −10 dB reference line (i.e., 10 percent reflected power) indicates an example of an acceptable return loss at the input. Return loss curves are illustrated for antenna element heights of +0.1, +0.2 and +0.3 inches higher than the lowest elements. Also provided is a fourth return loss curve representing a nominal value determined as that of the lowest elements. All results are below the −10 dB representative threshold over the range of at least 6.3 GHz to 12 GHz.

Figure 10:
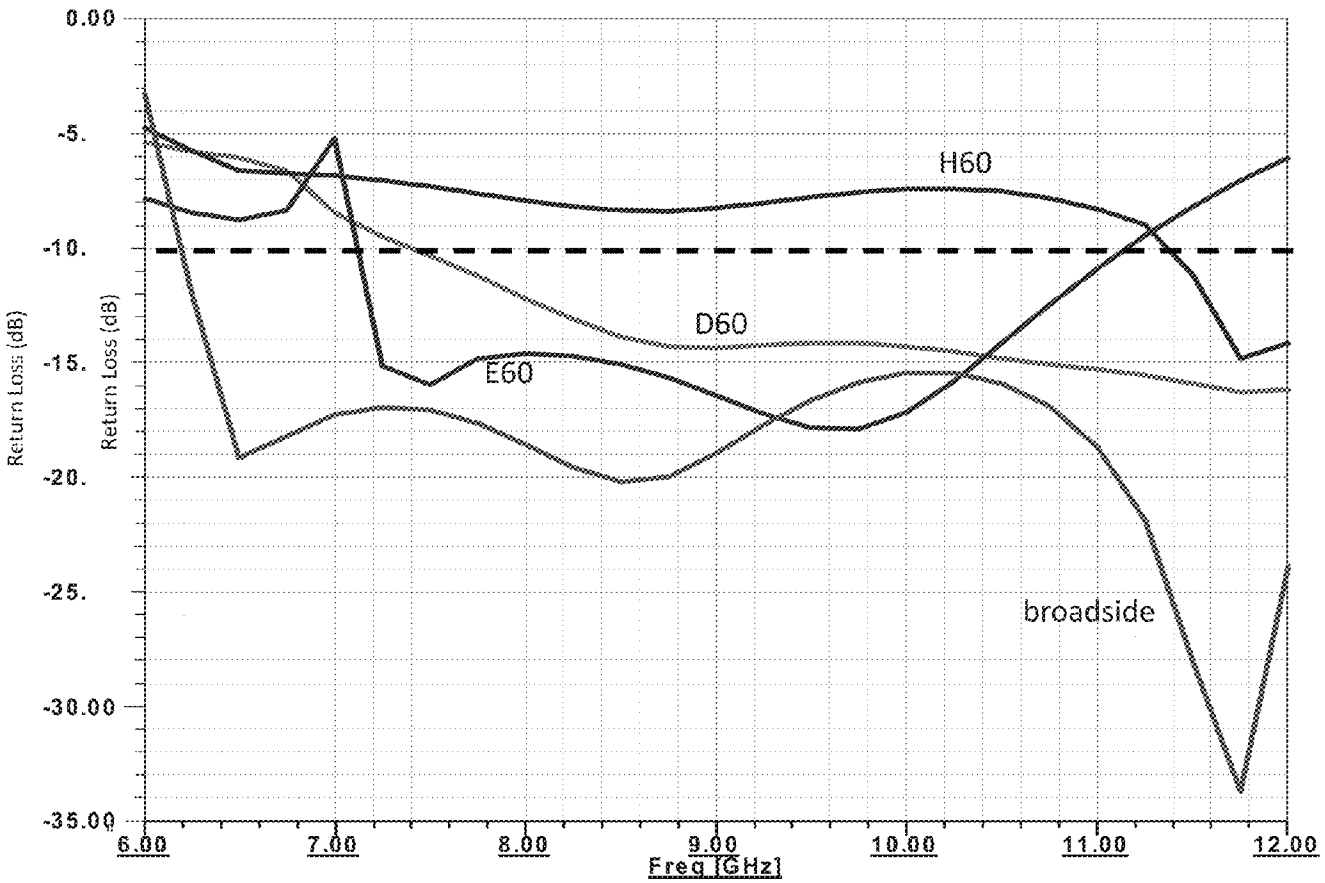
FIG. 10 shows a graphical representation of return loss versus frequency of an embodiment of a conformal antenna array assembly constructed according to the techniques described herein at various pointing angles.

Shown in FIG. 10, is a graphical representation of return loss versus frequency of an embodiment of a conformal antenna array assembly constructed according to the techniques described herein. Return loss curves are illustrated for antenna array angles of broadside, 60 degrees in the E-plane, 60 degrees in the H-plane, and 60 degrees in a diagonal plane for elements of +0.2 inch higher than the lowest elements. All angles are measured relative to broadside. In the illustrative example of an egg crate with flared notch elements, the broadside direction would be represented by a line perpendicular to the underlying horizontal ground plane and extending away from the ground plane in a direction of radiation of the elements. The E-plane generally refers to a plane in the radiation field containing predominantly the electric field radiated from the array elements. For non-crossed flared notches, the E-plane would generally coincide with a plane containing the flared notch structure. Similarly, the H-plane is selected to predominantly contain the magnetic field radiated from the array elements. The H-plane intersects the E-plane at 90 degrees forming a line coincident with bore sight. The diagonal plane is a plane intersecting same line formed by intersection of the E and H planes, but measured at some angle with respect to either plane (i.e., 45 degrees). Once again, a reference line representing a return loss of −10 dB is provided.

Any of the circuits described herein can be fabricated as integrated circuits having one or more electrically conductive layers (e.g., traces and ground planes) separated from each other by one or more insulting layers. Such circuits can be formed on a dielectric substrate, such as Silicon, Germanium, III-V materials, such as Gallium-Arsenide (GaAs), and combinations of such dielectrics. In some embodiments, the circuits are formed as a monolithic integrated circuit. Alternatively, circuits can be formed as multi-chip assemblies.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. An antenna array comprising:

an electrically conducting ground plane;

a first electrically conducting wall including a lower edge and an upper boundary, the first wall being in electrical contact with the ground plane along its lower edge and extending away from the ground plane, wherein each region of the upper boundary of the first electrically conducting wall is disposed at a different height, measured with respect to the ground plane;

a first plurality of antennas, each antenna disposed at a uniform distance relative to the upper boundary of the first wall;

a second electrically conducting wall including a lower edge and an upper boundary, the second wall also being in electrical contact with the ground plane along its lower edge and extending away from the ground plane, the second electrically conducting wall being substantially parallel to the first wall, wherein each region of the upper boundary of the second electrically conducting wall is disposed at a different height, measured with respect to the ground plane; and a second plurality of antennas, each antenna disposed at a uniform distance relative to the upper boundary of the second wall, wherein the first and second electrically conducting walls are separated from each other by a separation distance.

2. The antenna array of claim 1, wherein the separation distance is less than about one-half a shortest anticipated wavelength of operation.

3. The antenna array of claim 1, wherein each antenna of the first and second pluralities of antennas is positioned for maximum radiation in a direction away from the ground plane.

4. The antenna array of claim 3, wherein each antenna of the first and second pluralities of antennas is selected from the group consisting of: notch antennas; dipole antennas; patch antennas; travelling wave antennas; directional antennas; and combinations thereof.

5. The antenna array of claim 1, wherein each antenna of the first and second pluralities of antennas is defined by a conducting region on an insulating substrate and each of the first and second electrically conducting walls is also defined by a conducting region on the insulating substrate.

6. The antenna array of claim 5, wherein the substrate comprises a structural support.

7. The antenna array of claim 1, further comprising:

an orthogonal electrically conducting wall extending between a lower edge and an upper boundary, the orthogonal wall being in electrical contact with the ground plane along its lower edge and extending away from the ground plane, the orthogonal wall also intersecting each of the first and second walls at an intersection angle; and a third plurality of antennas, each antenna disposed at a uniform distance relative to the upper boundary of the orthogonal wall.

8. The antenna array of claim 7, wherein the intersection angle is substantially 90 degrees.

9. The antenna array of claim 7, wherein intersection of the orthogonal wall with the first wall bisects a respective antenna of the first plurality of antennas and a respective antenna of the third plurality of antennas, and intersection of the orthogonal wall with the second wall bisects a respective antenna of the second plurality of antennas and another respective antenna of the third plurality of antennas.

10. The antenna array of claim 9, wherein each of the bisected antenna pair of the first and third pluralities of antennas and the second and third pluralities of antennas is adapted for common-phase center, dual-polarization, or elliptical-polarization operation.

11. The antenna array of claim 1, further comprising a respective antenna interface port for each antenna of the first and second pluralities of antennas, an electrical length between each antenna of the respective plurality of antennas and its respective antenna interface port being substantially the same.

12. The antenna array of claim 1, wherein electrical contact between each of the first and second walls and the ground plane comprises a plurality of contact points separated by gaps along the respective bottom edge and the ground plane for each antenna of the respective plurality of antennas.

13. The antenna array of claim 12, wherein the plurality of contact points comprises two contact points.

14. The antenna array of claim 1, further comprising a phase offset in electrical communication between different antennas of the pluralities of antennas, the phase offsets being adapted to steer a radiation pattern of the antenna array.

15. The antenna array of claim 14, wherein the phase offset is adjustable.

* * * * *